US009630311B2

(12) United States Patent
Creelman

(10) Patent No.: US 9,630,311 B2
(45) Date of Patent: Apr. 25, 2017

(54) PISTOL GRIP ATTACHMENT FOR USE WITH A PAINTBRUSH

(71) Applicant: Charlie Creelman, Washington, MI (US)

(72) Inventor: Charlie Creelman, Washington, MI (US)

( * ) Notice: Subject to any disclaimer, the term of this patent is extended or adjusted under 35 U.S.C. 154(b) by 0 days.

(21) Appl. No.: 14/757,588

(22) Filed: Dec. 23, 2015

(65) Prior Publication Data

US 2016/0176039 A1 Jun. 23, 2016

Related U.S. Application Data

(60) Provisional application No. 62/096,152, filed on Dec. 23, 2014.

(51) Int. Cl.

| | |
|---|---|
| ***B25G 3/20*** | (2006.01) |
| ***B25G 1/10*** | (2006.01) |
| ***B44D 3/12*** | (2006.01) |
| ***A45F 5/02*** | (2006.01) |

(52) U.S. Cl.

CPC ..... *B25G 1/102* (2013.01); *A45F 5/021* (2013.01); *B25G 3/20* (2013.01); *B44D 3/123* (2013.01); *A45F 2200/0575* (2013.01); *A45F 2200/0591* (2013.01)

(58) Field of Classification Search

CPC . B25G 1/102; B25G 1/06; B25G 3/20; B44D 3/123; A45F 5/021; A45F 2200/0575; A45F 2200/0591

See application file for complete search history.

(56) References Cited

U.S. PATENT DOCUMENTS

| | | | | | |
|---|---|---|---|---|---|
| 1,980,087 | A | | 11/1934 | Rast | |
| 2,410,882 | A | * | 11/1946 | Lansden | A01D 1/14 16/110.1 |
| 2,706,423 | A | * | 4/1955 | Rose | B25B 9/00 30/168 |
| 2,914,785 | A | | 12/1959 | Ela | |
| 4,157,598 | A | | 6/1979 | Talent et al. | |
| 4,495,669 | A | | 1/1985 | Hooper | |
| 4,746,042 | A | * | 5/1988 | King | A45F 5/02 224/148.2 |
| 4,951,857 | A | * | 8/1990 | Carr | A45F 5/02 211/65 |
| 5,072,868 | A | * | 12/1991 | Dickie | B44D 3/123 220/736 |
| 5,499,637 | A | * | 3/1996 | Foti | A45D 19/02 132/112 |

(Continued)

*Primary Examiner* — Corey Skurdal

(74) *Attorney, Agent, or Firm* — Dinsmore & Shohl LLP; Douglas McEvoy

(57) ABSTRACT

A pistol grip style attachment for use with a paintbrush having an extending handle, the attachment including a body having a configured gripping surface, with a channel defined in the body adapted to receive the handle. A clamping member is displaceable within the body in order to engage an underside location of the handle. In one embodiment, the body includes first and second assembleable halves, each further exhibiting a reinforced ribbed interior. A passageway communicates the channel defined between the assembleable halves with a bottom location of the body for seating the clamping member in a limited displaceable fashion.

18 Claims, 9 Drawing Sheets

(56) References Cited

U.S. PATENT DOCUMENTS

| | | | | |
|---|---|---|---|---|
| 5,511,705 | A * | 4/1996 | Dreszer | A45F 5/02 224/582 |
| 5,625,922 | A | 5/1997 | Morad | |
| 5,991,956 | A * | 11/1999 | Chapman | A46B 17/02 15/145 |
| 6,101,657 | A | 8/2000 | Hamilton | |
| 6,988,295 | B2 | 1/2006 | Tillim | |
| 7,178,191 | B2 | 2/2007 | Hitzler | |
| 8,595,883 | B1 | 12/2013 | Kern | |
| 8,839,480 | B2 | 9/2014 | Thomas | |
| 2002/0066151 | A1 | 6/2002 | Parker et al. | |
| 2002/0185509 | A1 * | 12/2002 | Wichman | A45F 5/00 224/677 |
| 2005/0278897 | A1 | 12/2005 | Tillim | |
| 2012/0294470 | A1 | 11/2012 | Saltalamacchia | |
| 2013/0061428 | A1 | 3/2013 | Freuler | |
| 2013/0061725 | A1 | 3/2013 | Freuler | |
| 2016/0166054 | A1 * | 6/2016 | Saltalamacchia | A46B 15/0036 362/119 |

* cited by examiner

PISTOL GRIP ATTACHMENT FOR USE WITH A PAINTBRUSH

CROSS-REFERENCE TO RELATED APPLICATIONS

This Application claims the benefit of U.S. Provisional Application 62/096,152 filed on Dec. 23, 2014, the contents of which are incorporated herein in its entirety.

FIELD OF THE INVENTION

The present invention relates generally to a grip attachment device for use with a standard paintbrush. More particularly, the present invention discloses an ergonomically shaped pistol grip attachment for securing to a paintbrush handle in a generally transverse extending fashion. The attachment includes first and second mating halves which assemble about an intermediate location of the handle. A mating interior of the assembled halves further exhibits a stepped or angled passageway for receiving, from a bottom communicating and actuating location, a clamping member which is upwardly displaceable in order to bias against a captured underside of the brush handle. A holster is provided for storing the brush and pistol grip attachment and includes a belt or clip attachment portion.

BACKGROUND OF THE INVENTION

The prior art is documented with examples of paint brush grips, a first example of which is shown in U.S. Pat. No. 5,991,956 and which illustrates a pistol style grip having ergonomic features. A top of the grip is exhibited by a pair of "V" shaped cradles extending from each of a rear arm and a short front arm. Between the arms, a strap is provided for encircling and capturing the paintbrush handle. The strap is secured to a top region of the pistol grip and is adjustable by either a Velcro or buckle cleat fastening arrangement.

US 2013/0061428 to Freuler teaches a counterweight device and system for a hand tool, such as a paintbrush, having a forward working end and a handle extending rearwardly along a longitudinal axis, having a distal end, with the hand tool having a center of gravity located on the axis forward of the midpoint between the working and distal ends, are disclosed. A counterweight device includes a counterweight body configured to be mounted to a portion of the handle, and one or more counterweights supported on the counterweight body. The counterweight device is thereby adapted to shift the center of gravity of the hand tool rearward along the axis of the handle to a predetermined extent when the counterweight body is mounted to the handle. A counterweight system includes a set of interchangeable counter counterweights each having a different weight and each configured to be removably attached either to the counterweight body or to a counterweight attached thereto.

Freuler, US 2013/0061725, teaches a related ergonomic hand tool holder that supports a tool for us, while being received comfortably in a user's hand in a natural resting angle relative to the wrist. The hand tool holder defines forefinger and thumb rest areas on outwardly-facing surfaces of side regions of the holder body, and hand rest areas adapted to engage and rest against the "saddle" of a user's hand when the holder is held with the forefinger and thumb rest engaging the forefinger and thumb rest areas. The weight of the holder and its supported load is distributed to the dorsal saddle area of the user's hand, allowing the user's arm to bear the weight, while the user's wrist and fingers guide, rather than carry, the tool. An ergonomic system may also include a counterweight device adapted to move the combined weight the load toward the hand rest area engaging the dorsal saddle area.

Other examples from the prior art include the integrally formed dual grip paint brush handle of Hooper, U.S. Pat. No. 4,495,669, and in which either of the conventionally extending brush handle or the integrally formed and angularly extending pistol grip handle can be grasped. Also referenced is the perpendicularly configured paint brush handle of Kern, U.S. Pat. No. 8,595,883, as well as the pistol style gripping handle of Ela U.S. Pat. No. 2,914,785 including palm grip and finger receiving holes.

SUMMARY OF THE INVENTION

The present invention discloses a pistol grip style attachment for use with a paintbrush having an extending handle, the attachment including a body having a configured gripping surface, with a channel defined in said body adapted to receive the handle. A clamping member is displaceable within the body in order to engage an underside location of the handle.

In one embodiment, the body includes first and second assembleable halves, each further exhibiting a reinforced ribbed interior. A passageway communicates the channel defined between the assembleable halves with a bottom location of the body for seating the clamping member in a limited displaceable fashion.

The passageway further can include a series of linear and oblique extending and interconnecting surfaces, with the clamping member exhibiting a mating configuration. An adjustment knob supported at a bottom location of the body, a threaded stem extending from the knob and engaging a nut secured to an interior location of the clamping member, rotation of the knob influencing the clamping member in either of an engaging or disengaging direction relative to the paintbrush handle.

Other features include the first and second halves further exhibiting opposing aligning locations for facilitating inter-assembly of the halves, a plurality of screws securing the halves together. A holster is also provided for receiving a brush end of the paintbrush along with supporting a forward configured edge of the body. A rigid collar attachment is secured to a top perimeter edge of the holster, as is a belt support clip for releasably engaging the holster.

A slot is defined in the clip which receives an angled ledge extending from the holster body. The belt support clip further exhibits first and second extending legs terminating in upper end and reverse angled belt engaging portions.

BRIEF DESCRIPTION OF THE DRAWINGS

Reference will now be made to the attached drawings, when read in combination with the following detailed description, where in like reference numerals refer to like parts throughout the several views, and in which.

DETAILED DESCRIPTION OF THE PREFERRED EMBODIMENTS

Figure 1:
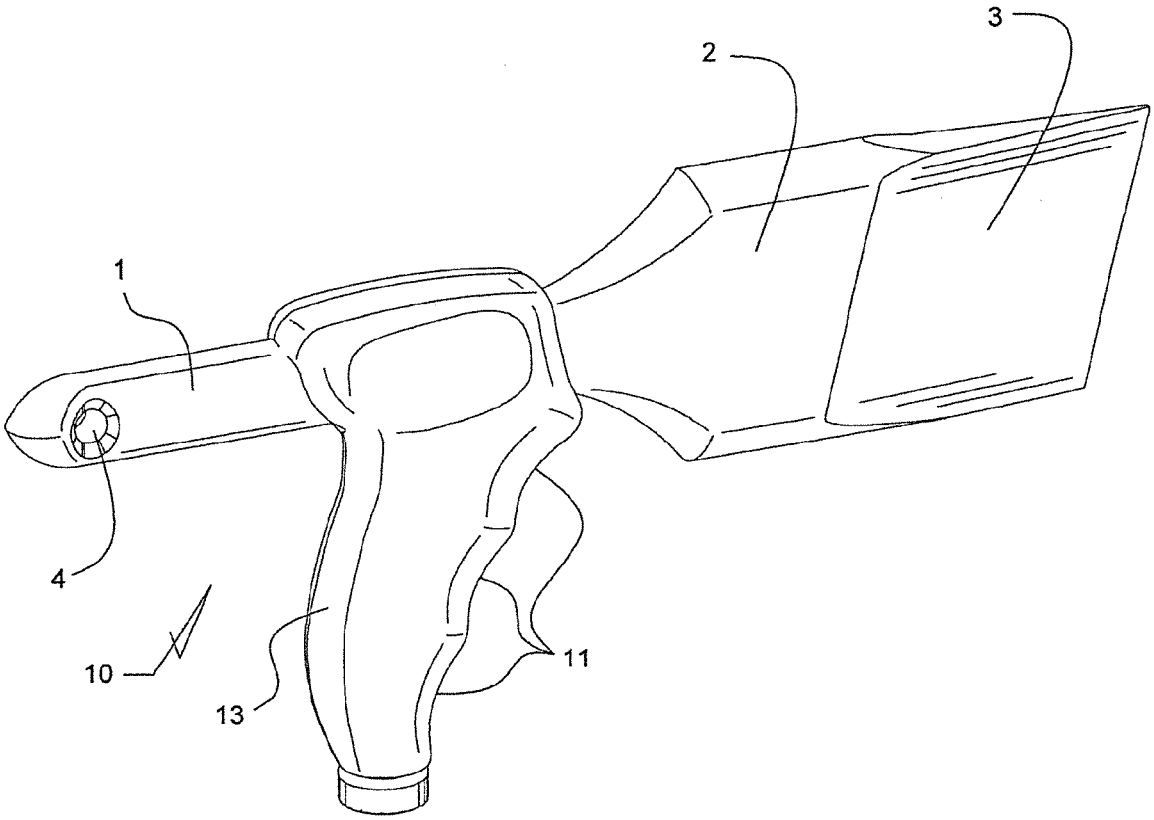
FIG. 1 is an environmental view of the pistol grip style brush handle attachment mechanism of the present invention.
Figure 2:
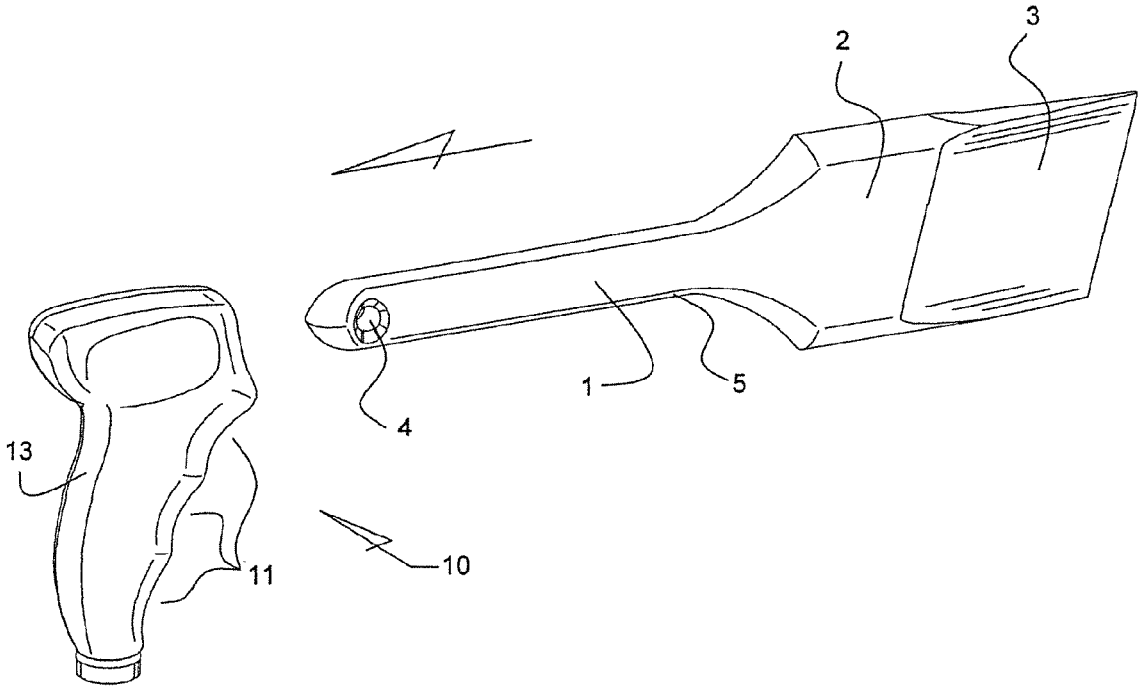
FIG. 2 is a succeeding illustration to FIG. 1 and illustrating the conventional paintbrush handle separated from the upper receiving end of the pistol grip style attachment.

With reference to the appended illustrations, and referring initially to the environmental view of FIG. 1 and the successive exploded/separated view of FIG. 2, the present invention discloses an ergonomically shaped pistol grip attachment, shown generally at 10, for securing to a paintbrush handle 1 in a generally transverse extending fashion. As is known in the art, the handle 1 of the paintbrush converges at a front end to a widened body 2 which seats a plurality of bristles 3. Also shown at a rearmost end of the handle 1 is an inner aperture 4, such facilitating the mounting of a lanyard for suspending the paintbrush when not in use.

Figure 3:
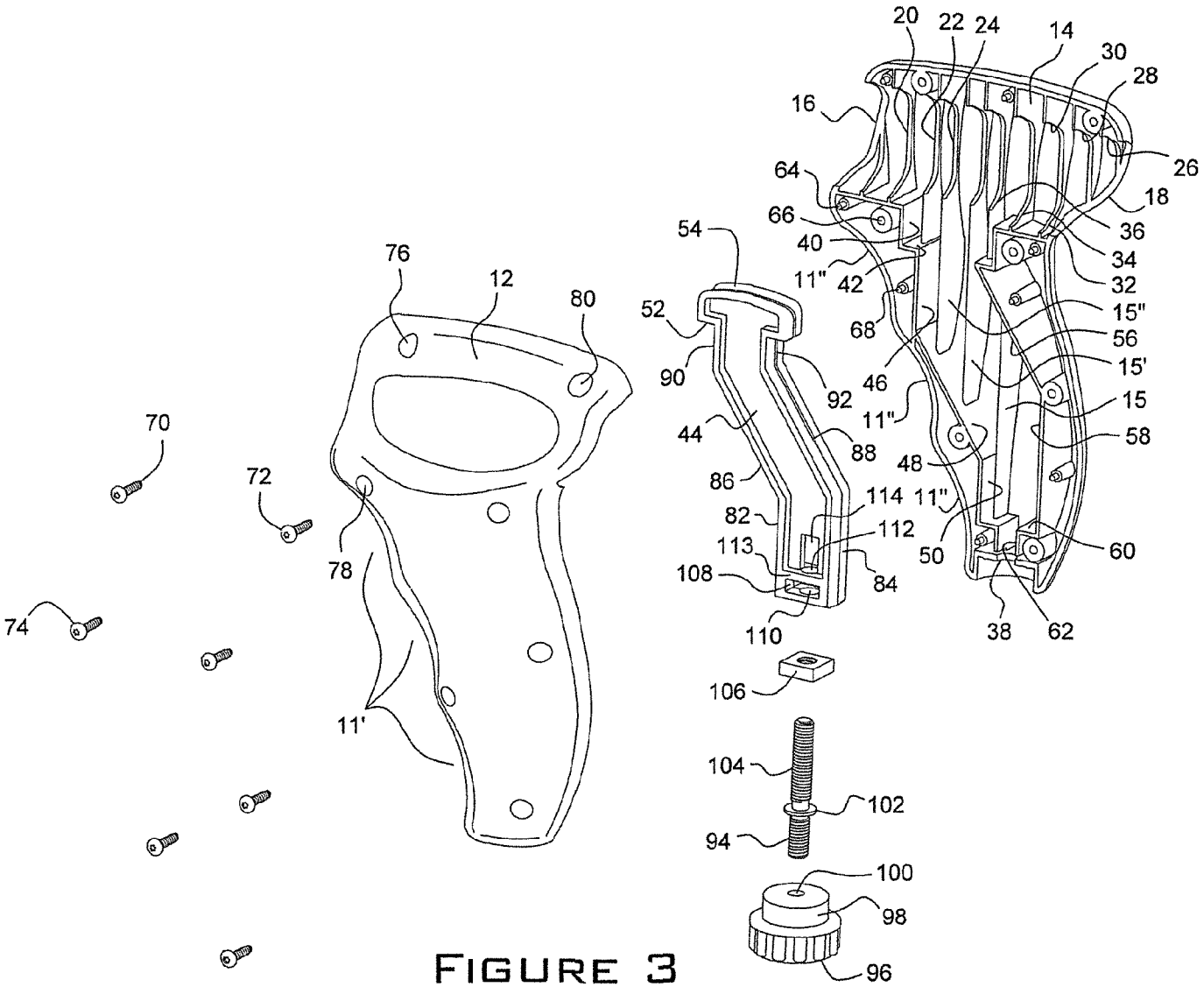
FIG. 3 is an exploded view of the pistol grip style attachment mechanism including first and second separable halves with inter-engaging screws, a combined angularly extending/stepped clamping member received within a vertically oblique seating profile established between the assembled halves, and a bottom end located rotating knob and threaded stem for upwardly influencing the clamping member and an uppermost located abutting portion into an abutting engagement with the captured underside location of the brush handle.

FIG. 3 is an exploded view of the pistol grip style attachment mechanism and including first 12 and second 14 separable halves which, when assembled, defines a three dimensional ergonomic style body with a finger grip front locations 11 and a smooth contoured rear surface 13 (see again as shown in FIGS. 1-2). As shown, the halves 12 and 14 each exhibit an ergonomically configured body with a smooth contoured outer surface terminating in the frontal grip defining edges (see as further shown at 11' and 11" for halves 12 and 14) and with each further having a generally ribbed or other structurally reinforced interior, this further best referenced by ribs 15, 15', 15" et seq. associated with the selected half 14 as shown in FIG. 3. Without limitation, the halves 12/14 can be constructed of a durable plastic or lightweight metal such as an aluminum.

As further depicted by selected attachment half 14 in FIG. 3, one half of the collective interior recess configuration resulting from the sandwiching engagement of the halves is shown and includes an upper most (front to back) receiving channel through which can be installed the brush handle 1. The upper most brush inserting channel is represented by front 16 and rear 18 configured aperture defining edges, between which are configured a plurality of ribbed interior locations exhibiting recessed inner profile edges, see further at 20, 22, 24, et seq. As further shown, the dimensions of the brush handle receiving channel are further exhibited by top 26, 28, 30, et. seq. and bottom 32, 34, 36 et. seq. configured inner locations associated with the upper ribbed profile.

Figure 4:
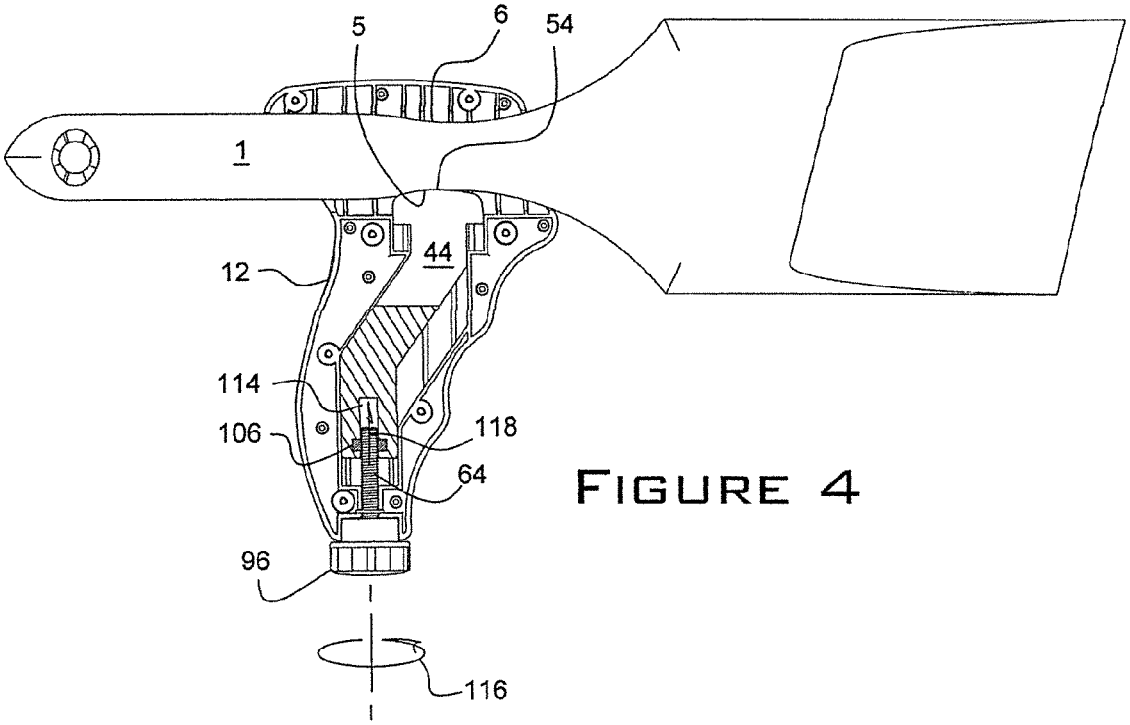
FIG. 4 is a first assembled plan view with an outer selected grip half removed and illustrating the clamping member in an upwardly biasing and engaged position with the brush handle.

Also exhibited by the interior facing side of selected handle assembled half 14 is a generally vertically ascending and stepped interior communicating profile extending from a bottom most seating location 38 to an upper most inwardly stepped location (see annular ledge defining surfaces 40 and 42), this defining a receiving passageway for a clamping member 44 for biasing against and inserted (captured) underside location of the brush handle 1 (see FIG. 4). The receiving passageway as best shown in separated half 14 includes an oblique angled/stepped configuration which, in combination with an identical and mating configuration associated with the inside interior face of the first half 12 (see also FIGS. 4-5) is consistent with the profile established by the inner supported and displaceable clamping member 44.

Specifically, and as shown in FIG. 3, one extending side of the passageway depicted by the interior configuration of the assembleable half 14 includes a series of progressive and interconnected linear 46, angled 48, and offset linear 50 surfaces extending from an uppermost ledge surface 42 (which is associated with an underside seating location 52 of an uppermost abutting portion 54 of the stepped clamping member 44). A spaced apart and inner facing/opposing surface profile of the passageway further includes an angled surface 56 extending downwardly from the ledge surface 42, and a linear interconnecting 58 surface. The vertical surfaces 50 and 58 extend to a bottom most ledge surface 60, which in turn is communicated by a narrowed passageway 62 communicable with the bottom seating location 38.

Additional features include pluralities of locating/fastener receiving portions which are defined in each of the inter-assembleable halves and as further depicted by each of pin locations 64, 68, et seq. as well as recess collar shaped portions, e.g. at 66, for selected half 14. This can include the halves 12 and 14 being formed as injection molded components with the mating inner sides exhibiting any suitable pin and hole mating profile (typically in plural opposing fashion as shown) and in order to ensure proper alignment of the halves during assembly.

As further shown, a plurality of screws are depicted and include those selectively referenced at 70, 72, 74, et seq., and which, upon aligning the halves 12 and 14 for assembly, are inserted through associated apertures 76, 78, 80, et seq. defined in the exterior side of selected halve 12 in order to engaged selected recess collar style portions (see again as referenced at 66) associated with the locating/fastening receiving portions of the other assembleable half 14 as described above. Prior to assembly of the halves 12/14, the clamping member 44 is seated within the passageway as further defined by rotating inside view of selected half 12 in FIGS. 4-5, the features of which are mirrored by those referenced in further selected half 14 such that a repetitive description of which is unnecessary.

As further best shown in FIG. 3 the clamping member 44, also typically a plasticized component similar to the material construction of the halves 12/14, includes a combination stepped and angled profile including bottom linear sides 82/84, intermediate angled sides 86/88 and uppermost offset and linear sides 90/92. Adjustment structure associated with the clamping member further includes a threaded stem having a lower portion 94 which is engaged by an adjustment knob 96 having a collar shaped and knurled outer perimeter, with an inner diameter dimensioned upper location 98 (this seating within the underside 38 of the assembled halves 12/14), and an inner recess 100 (typically interiorly threaded) for receiving the lower portion 94 of the stem to an intermediate abutment location 102 configured upon the threaded stem. Alternatively, the adjustment knob 96 and threaded stem can be formed as a single piece.

Figure 5:
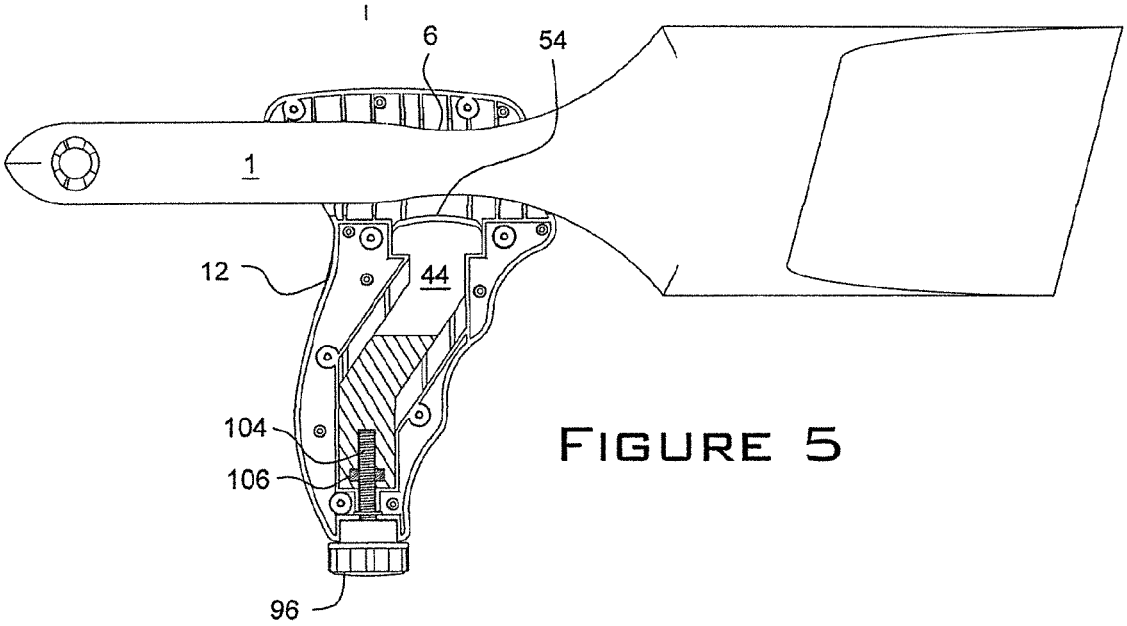
FIG. 5 is succeeding view to FIG. 4 depicting the clamping member in an unseated and downwardly retracted position relative to the brush handle resulting from counter-rotation of the bottom located knob in order to rotate the threaded stem in a reverse direction relative to the interiorly threaded nut captured within a bottom proximate location of the clamping member.

An upper and exteriorly threaded portion 104 of the stem is provided extending from the intermediate abutment location 102 opposite the lower threaded portion 94 of the stem and, as further depicted in FIGS. 4-5, provides the range of combined linear and angular/oblique adjustment of the clamping member 44 such that its upper most abutting portion 54 exerts a maximum restraining force against a captured underside location 5 (see FIGS. 1 and 4) of the handle 1, with an opposite upper side location 6 being likewise biased against the inside curved edge locations of the upper ribbed portions (see again at 26, 28, 30, et seq.) of the linear brush receiving profile defined in the halves 12/14 and in order to maximize the restraining forces to prevent movement of the brush relative to the pistol shaped attachment.

Referencing again FIG. 3, a rectangular shaped nut 106 is provided and seats within a bottom most three sided pocket, see as designated at 108, defined at a bottom proximate location of the clamping member 44. A pair of spaced apart and aligning apertures are exhibited by inner circumferential walls 110 and 112 within each of a bottom face (for aperture 110) of the clamping member and an upwardly spaced ledge 113 (within which is defined the further aligning aperture 112). The upper threaded portion 104 of the stem rotatably inserts through the inner threads of the rectangular nut 104, upon the same being pre-inserted into the restraining pocket 108 defined between the bottom end of the clamping member 44 and the upwardly spaced ledge 113, concurrent with the upper portion 104 passing through the aligning aperture defined walls 110 and 112, the uppermost portion of the upper threaded portion 104 seating within a linear travel pocket defined inside the lower range of the clamping member 44, and which is further depicted by a three sided recessed configuration 114 in FIG. 3 (an identical configuration in the mating half 12 defining a sleeve shaped recess for receiving the upper threaded portion 104.

As shown by the cutaway profile of the clamping member in each of FIGS. 4-5, the upper threaded portion 104 of the stem linearly travels within the recess profile 114 concurrent with the directional forces generated from the threaded rotation (arrow 116) to linear translation (arrow 118) of threaded stem portion 104 relative to the captured nut 106.

As shown in FIG. 4, the clamping member 44 is depicted in an upwardly displaced, biasing and engaged position with the brush handle, resulting from the lifting forces generated between the shaft 104 and the nut 106 pushing the clamping member 44 upwardly into engagement with the underside surface 5 of the brush handle 1, concurrently squeezing the upper side surface 6 against the inside ribbed edge locations 26, 28, 30, et seq. of each assembled half 12/14.

Following reverse direction rotation of the adjustment knob 96 (opposite to directional arrow 116), FIG. 5 successively depicts the clamping member 44 in an unseated and downwardly retracted position relative to the brush handle 1, resulting in the threaded stem 104 traveling in a reverse direction relative to the interiorly threaded nut 106 captured within a bottom proximate location of the clamping member. As further shown, the stem portion 104 travels upwardly relative to the interior defined passageway 114, concurrently with the rotational to linear forces exerted on the nut 106 pulling the clamping member 44 downwardly out of engagement with the brush handle 1, with the interior dimensions of the passageway defined in the mating halves 12/14 providing a desired range of travel for the clamping member 44 along both the linear and interconnecting angled surfaces. Furthermore, the angled surface, see at 56 for half 14 in FIG. 3, provides an oblique supporting surface for the contacting surface 88 of the clamping member and for assisting in directing the uppermost abutting portion 54 of the clamping member 44 into an abutting engagement with the brush handle 1.

Figure 6:
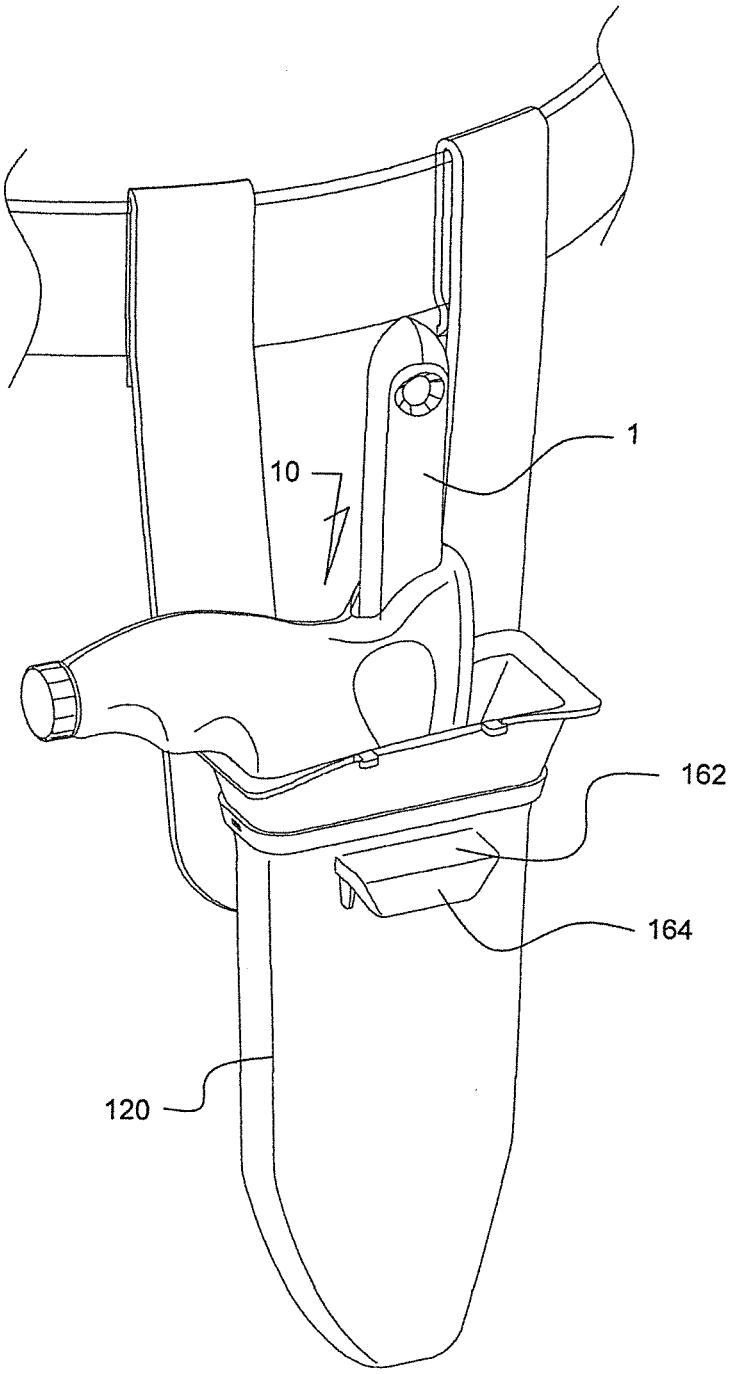
FIG. 6 is an environmental view of the brush and pistol style grip attachment in combination with a holster and belt mounting accessory according to a related assembly of the present inventions.
Figure 7:
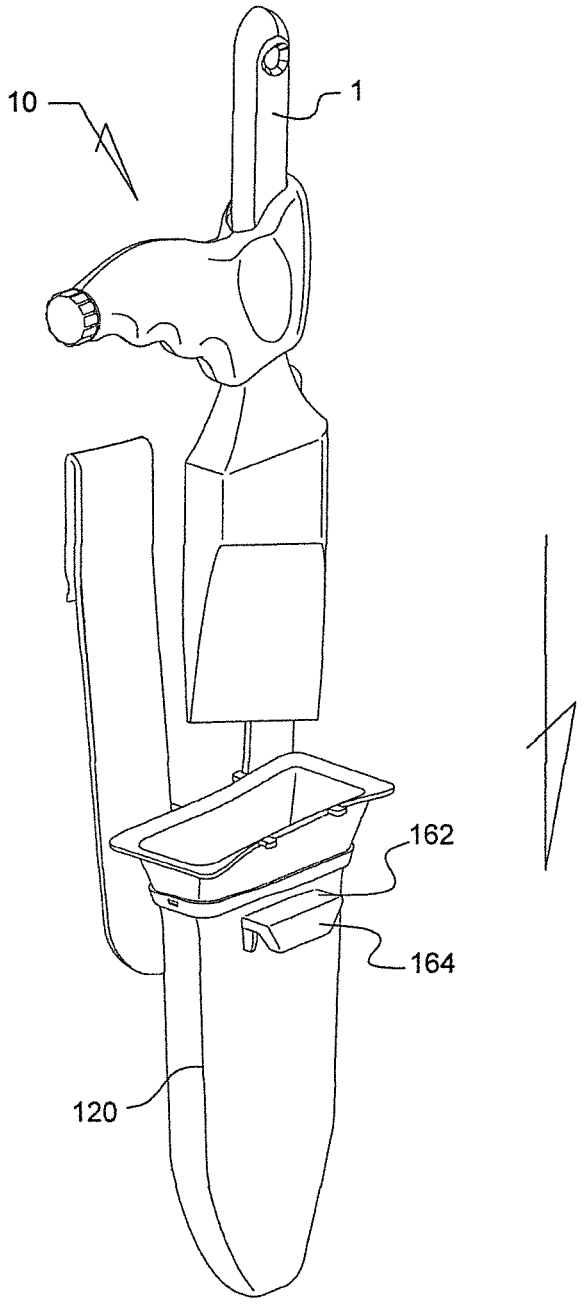
FIG. 7 is a succeeding an vertically unseating illustration of the brush and grip attachment relative to the holster.

Proceeding to FIG. 6, an environmental view is shown of the brush and pistol style grip attachment 10 in combination with a holster and belt mounting accessory according to a related assembly of the present inventions, with FIG. 7 a succeeding an vertically unseating illustration of the brush and grip attachment relative to the holster. As best depicted in FIG. 8, an exploded view of the holster assembly illustrates a main receiving body 120 (such as including any plastic or other material) having a generally open interior of a shape and depth suitable for receiving and seating the widened body 2 and bristle end 3 of the brush.

Figure 8:
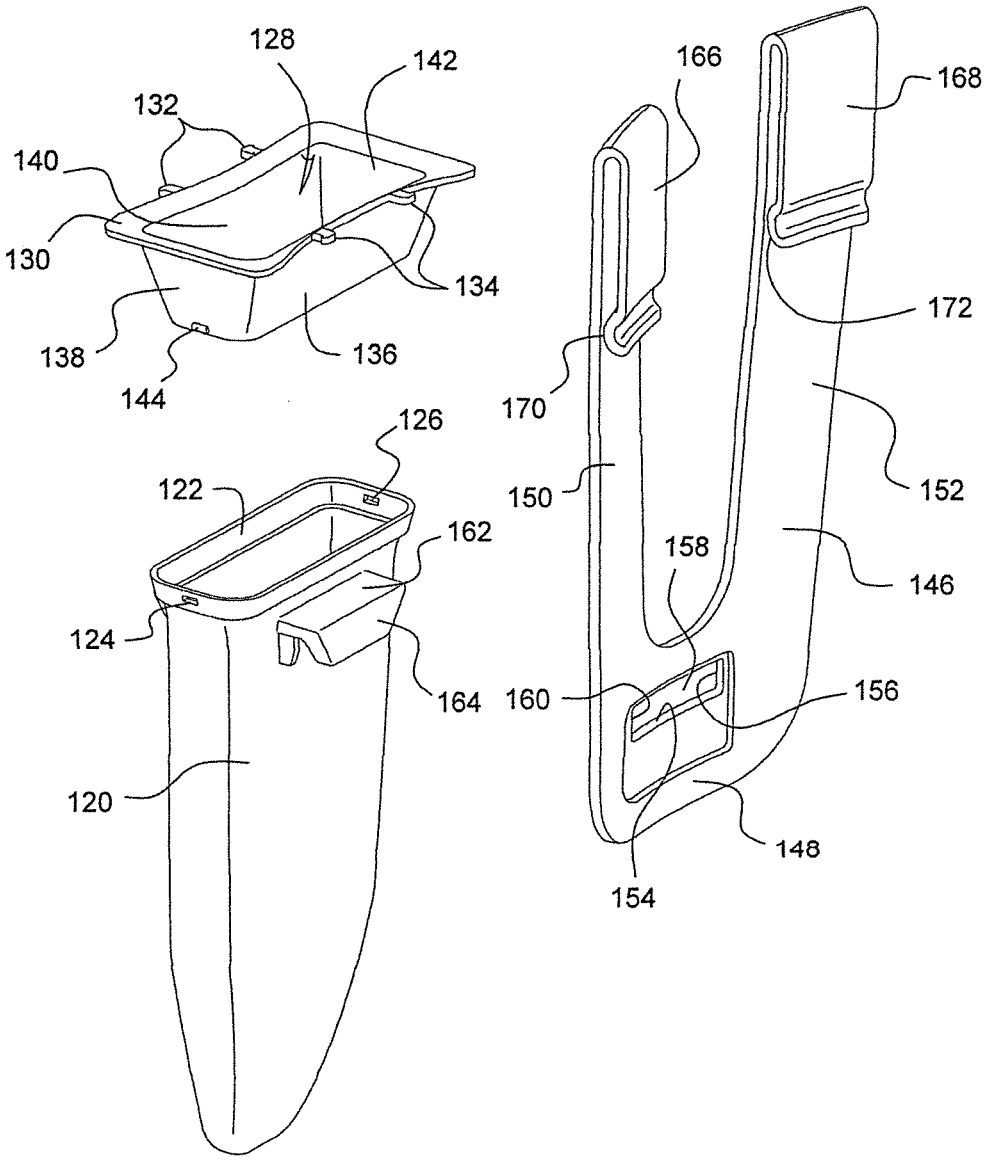
FIG. 8 is an exploded view of the holster assembly and illustrating the main receiving body with open upper rim, a rigid top attachable collar for supporting the forward configured edge of the pistol grip, and a support component including a bottom mounting location for securing the holster and a pair of top belt clip mounting locations.

The body 120 further exhibits an open upper, generally four sided, rim 122 (see FIG. 8). A pair of end slots 124 and 126 are configured in opposite ends of the rim 122. A rigid top attachable collar, generally at 128, can include a plastic material and exhibits an outer upper rim edge 130, which is also generally rectangular shaped and includes pairs 132 and 134 of projecting tabs extending from opposite side edges thereof.

A four sided and inwardly angled well or body of the collar 128 is exhibited by sides 136, 138, 140 and 142 and communicates with an open bottom (not shown). A pair of tabs are provided at bottom opposite ends of the well (see selected tab 144 for side 138 in sectional cutaway of FIG. 13) and which resistively seat within the end slots 124 and 126 in order to secure the rigid upper collar 128 to the upper end of the holster 120.

As shown in FIG. 6, the upper flared shaping of the rigid collar 128 is configured for supporting the forward configured edge of the pistol grip. It is also envisioned that the holster assembly need not include a separately attachable upper collar, with the components 120 and 128 envisioned as being produced as a single injection molded or otherwise formed component.

Additional features include the provision of supporting structure for mounting the holster 120 to a belt clip 146. The clip 146 can also exhibit a flexible plastic or like material and, as shown, includes a generally "V" or "U" shaped body with a base 148 interconnecting a pair 150 and 152 of upwardly extending legs. An inside facing location of the clip base exhibits a recess area (optional) and which further exhibits a rectangular slot shaped aperture (see as depicted in FIG. 8 by inner aperture defining interconnecting sides 154, 156, 158 and 160).

The holster body 120 further exhibits, along an inner facing side, an engagement ledge exhibited by an intermediate horizontal portion 162 and an interconnected and successively downwardly turned 164 portion. Assembly of the holster 120 to the clip 146 is accomplished by manipulating the ledge portion 164 through the rectangular slot in the clip so that the underside of the horizontal portion 162 is supported upon the bottom perimeter defining surface 154. Reverse disassembly/removal of the holster 120 is accomplished by pivoting and retracting the ledge defining portions 162 and 164 in a reverse manipulating fashion. Additional features associated with the belt mounting clip include the upwardly extending legs 150 and 152 exhibiting inwardly folded upper ends, see at 166 and 168, which terminated in reverse angled locations in biasing end locations 170 and 172, these being adapted to engage a belt or upper pant edge of a wearer in order to support the holster 120.

Figure 9:
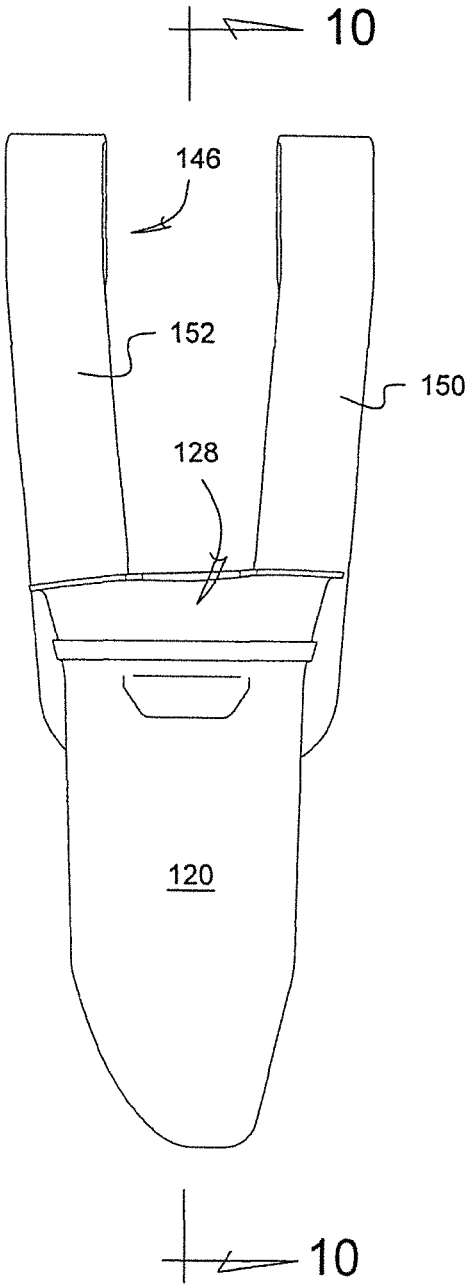
FIG. 9 is an assembled plan view of the holster assembly.
Figure 10:
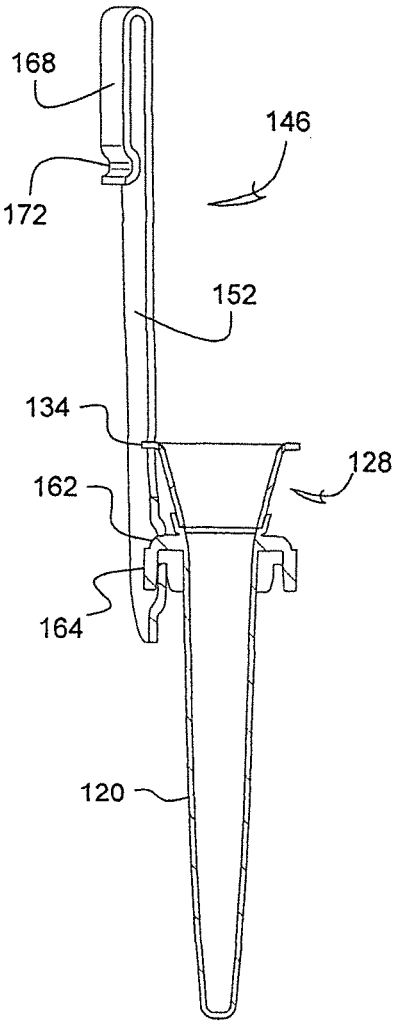
FIG. 10 is a first rotated side plan view in cutaway along line 10-10 of FIG. 9 of the holster assembly and showing the engagement profile established between the holster and support component, as well as the upper belt clip securing ends of the support component.

FIG. 9 is an assembled plan view of the holster assembly, with FIG. 10 a first rotated side plan view in cutaway, along line 10-10 of FIG. 9 of the holster assembly and showing the engagement profile established between the holster and support component, as well as the upper belt clip securing ends of the support component. FIG. 10 further depicts an additional supporting aspect of the collar 128, see tabs 134, which can seat within apertures configured within intermediate and aligning locations of the spaced apart legs 150 and 152 against which the tabs abut upon assembling the holster body 120 to the clip 146.

Figure 11:
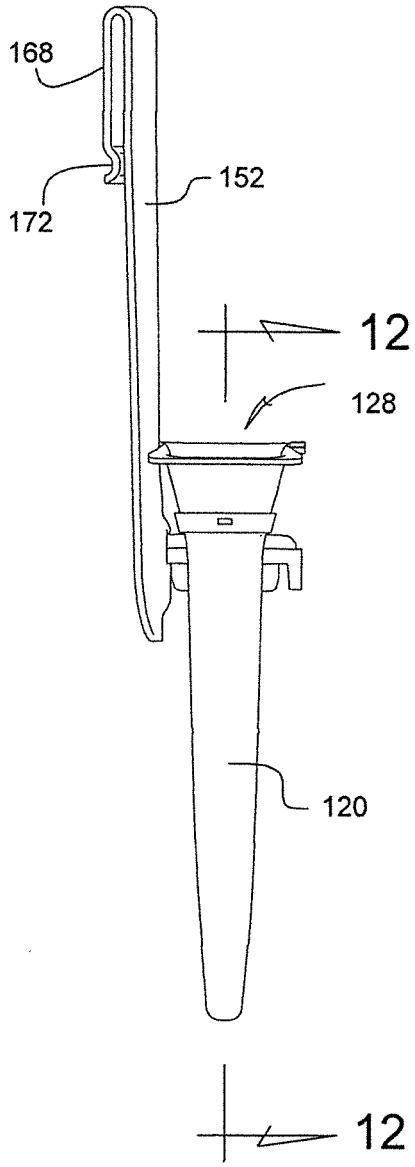
FIG. 11 is a further rotated side plan view of the holster assembly in solid depiction.
Figure 12:
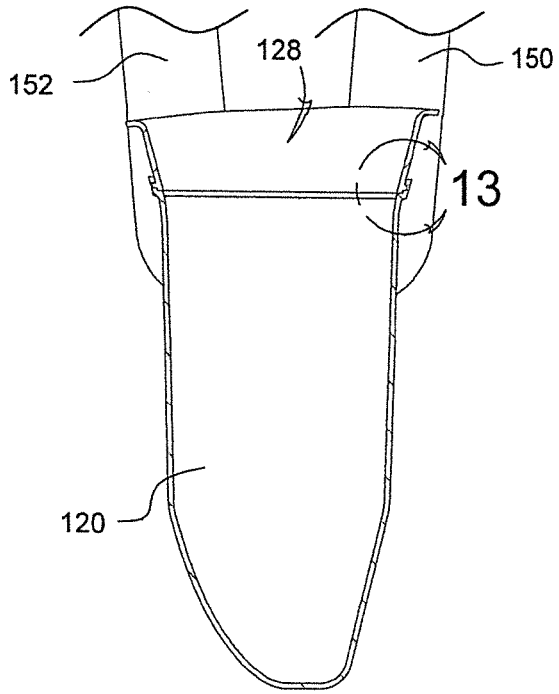
FIG. 12 is a cutaway view taken along line 12-12 of FIG. 11 and showing the interior receiving profile of the holster.
Figure 13:
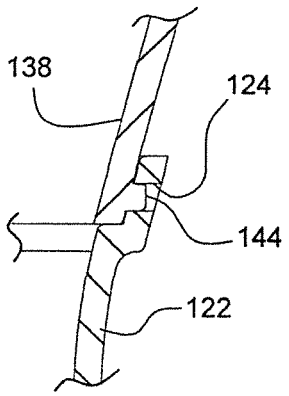
FIG. 13 is an enlarged partial view taken of area 13 in FIG. 12 and illustrating a selected tab and slot resistive engagement interface established between the upper end of the holster body and the top attached collar as also shown in FIG. 8.

FIG. 11 is a further rotated side plan view of the holster assembly in solid depiction, with FIG. 12 a cutaway view taken along line 12-12 of FIG. 11 and showing the interior receiving profile of the holster body 120. Finally, FIG. 13 is an enlarged partial view taken of area 13 in FIG. 12 and illustrating a selected tab 144 and slot 124 resistive engagement interface established between the upper end of the holster body 120 and the top attached collar 128, as also shown in FIG. 8.

Having described my invention, other and additional preferred embodiments will become apparent to those skilled in the art to which it pertains, and without deviating from the scope of the appended claims.

I claim:

1. A pistol grip style attachment for use with a paintbrush having an extending handle, said attachment comprising:

a body having a configured gripping surface, a channel defined in said body adapted to receive the handle;

a clamping member displaceable within said body in order to engage an underside location of the handle; and a passageway communicating said channel with a bottom location of said body and seating said clamping member in a limited displaceable fashion, said passageway further having a series of linear and oblique extending surfaces, said clamping member exhibiting a mating configuration.

2. The attachment as described in claim 1, said body further comprising first and second assembleable halves.

3. The attachment as described in claim 2, each of said halves further comprising a reinforced ribbed interior.

4. The attachment as described in claim 2, said first and second halves further comprising opposing aligning locations for facilitating inter-assembly of said halves.

5. The attachment as described in claim 2, further comprising a plurality of screws for securing said halves together.

6. The attachment as described in claim 1, further comprising an adjustment knob supported at a bottom location of said body, a threaded stem extending from said knob and engaging a nut secured to an interior location of said clamping member, rotation of said knob influencing said clamping member in either of an engaging or disengaging direction relative to the paintbrush handle.

7. The attachment as described in claim 1, further comprising a holster for receiving a brush end of the paintbrush along with supporting a forward configured edge of said body.

8. The attachment as described in claim 7, further comprising a rigid collar attachment secured to a top perimeter edge of said holster.

9. The attachment as described in claim 7, further comprising a belt support clip for releasably engaging said holster.

10. The attachment as described in claim 9, further comprising a slot defined in said clip which receives an angled ledge extending from said holster body.

11. The attachment as described in claim 9, said belt support clip further comprising first and second extending legs terminating in upper end and reverse angled belt engaging portions.

12. A pistol grip style attachment for use with a paintbrush having an extending handle, said attachment comprising:

a body having first and second assembleable halves exhibiting a configured outer gripping surface;

a channel defined in said body which is adapted to receive the handle;

a clamping member displaceable within said body in order to engage an underside location of the handle; and a passageway defined between said assembleable halves, said passageway communicating said channel with a bottom location of said body and seating said clamping member in a limited displaceable fashion, said passageway and clamping member each defining a series of mating linear and oblique extending surfaces permitting a range of displacement of said clamping member.

13. The attachment as described in claim 12, further comprising an adjustment knob supported at a bottom location of said body, a threaded stem extending from said knob and engaging a nut secured to an interior location of said clamping member, rotation of said knob influencing said clamping member in either of an engaging or disengaging direction relative to the paintbrush handle.

14. The attachment as described in claim 12, further comprising a holster for receiving a brush end of the paintbrush along with supporting a forward configured edge of said body.

15. The attachment as described in claim 12, further comprising a belt support clip for releasably engaging said holster.

16. A combination pistol grip style attachment and holster for use with a paintbrush having an extending handle, said combination comprising:

the attachment including a first body constructed of separable halves having a configured gripping surface, a channel defined between said halves and, upon assembly, being adapted to receive the handle so that said halves are adapted to encapsulate a portion of the inserted handle;

a clamping member displaceable within said body in order to engage an underside location of the handle and to bias an upperside location of the handle against an upper extending perimeter edge of the channel;

the holster including a second body having a generally open interior of a shape and depth adapted for receiving and seating a widened body and bristle end of the brush; and a belt support clip for releasably engaging said second body, said belt support clip further comprising first and second extending legs terminating in upper end and reverse angled belt engaging portions.

17. The combination pistol grip attachment and holster as described in claim 16, further comprising a rigid collar attachment secured to a top perimeter edge of said holster.

18. The combination pistol grip attachment and holster as described in claim 16, a passageway communicating said channel with a bottom location of said body and seating said clamping member in a limited displaceable fashion, said passageway further having a series of linear and oblique extending surfaces, said clamping member exhibiting a mating configuration.

* * * * *